US007747184B2

(12) United States Patent
DiRubio et al.

(10) Patent No.: US 7,747,184 B2
(45) Date of Patent: Jun. 29, 2010

(54) METHOD OF USING BIASED CHARGING/TRANSFER ROLLER AS IN-SITU VOLTMETER AND PHOTORECEPTOR THICKNESS DETECTOR AND METHOD OF ADJUSTING XEROGRAPHIC PROCESS WITH RESULTS

(75) Inventors: Christopher Auguste DiRubio, Webster, NY (US); Michael F. Zona, Holley, NY (US); Charles Anthony Radulski, Macedon, NY (US); Aaron Michael Burry, West Henrietta, NY (US); Palghat Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 606 days.

(21) Appl. No.: 11/644,277

(22) Filed: Dec. 22, 2006

(65) Prior Publication Data

US 2008/0152369 A1 Jun. 26, 2008

(51) Int. Cl.
*G03G 15/00* (2006.01)

(52) U.S. Cl. ..... 399/48; 399/26

(58) Field of Classification Search ..... 399/26, 399/48, 159

See application file for complete search history.

(56) References Cited

U.S. PATENT DOCUMENTS

| | | | | |
|---|---|---|---|---|
| 6,611,665 | B2 | 8/2003 | DiRubio et al. | |
| 6,807,390 | B2 | 10/2004 | Suda et al. | |
| 6,917,770 | B2 | 7/2005 | Bae et al. | |
| 7,024,125 | B2 | 4/2006 | Ishii et al. | |
| 2006/0165424 | A1 * | 7/2006 | Tabb et al. | 399/48 |
| 2006/0222381 | A1 * | 10/2006 | Moriya et al. | 399/26 |

* cited by examiner

*Primary Examiner*—Hoang Ngo
(74) *Attorney, Agent, or Firm*—Fay Sharpe LLP

(57) ABSTRACT

The dielectric thickness of a photoreceptor is determined in a variety of ways, including using a relationship between threshold voltage and dielectric thickness, using a relationship between dielectric thickness and the difference between biased transfer roller (BTR) voltage and photoreceptor surface potential, using a relationship between dielectric thickness and biased charging roller (BCR) impedance, using a relationship between dielectric thickness and the slope of the DC current vs. voltage curve for the BTR or the BCR, and using a relationship between dielectric thickness and the BTR voltage at zero current. The threshold voltage can be found by using the slope of the BCR DC current vs. voltage curve, measuring photoreceptor surface potential for a plurality of target values below the charging knee to obtain the intercept value, or finding the actual value of the charging knee. A method of using the BCR as an electrodynamic voltmeter is also disclosed.

21 Claims, 9 Drawing Sheets

METHOD OF USING BIASED CHARGING/TRANSFER ROLLER AS IN-SITU VOLTMETER AND PHOTORECEPTOR THICKNESS DETECTOR AND METHOD OF ADJUSTING XEROGRAPHIC PROCESS WITH RESULTS

CROSS-REFERENCE TO RELATED APPLICATIONS

This application is related to U.S. patent application Ser. No. 11/644,276, filed on the same date as this application, Dec. 22, 2006, invented by Aaron M. Burry, Christopher A. DiRubio, Michael F. Zona, and Paul C. Julien, and entitled, "Improved Photoconductor Life Through Active Control of Charger Settings," the disclosure of which is hereby incorporated by reference.

This application is also related to U.S. Pat. No. 6,611,665 to Christopher A. DiRubio et. al., is co-owned, and shares at least one common inventor with the patent. The '665 patent discloses a method and apparatus for using a biased transfer roll as a dynamic electrostatic voltmeter for system diagnostics and closed loop process controls and its disclosure is hereby incorporated by reference.

BACKGROUND AND SUMMARY

Xerographic reproduction apparatus use a photoreceptor in the form of a drum or a belt in the creation of electrostatic images upon which toner is deposited and then transferred to another electrostatically charged belt or drum, or to paper or other media. Once the toner image is transferred, most xerographic apparatus clean the photoreceptor in ways that can abrade the surface, changing the thickness of the photoreceptor over time. Even without such abrasion, the thickness of the photoreceptor will decrease through use over time. Because of the nature of the photoreceptor, a change in thickness will result in a change in its electrostatic performance, which can be measured by the "dielectric thickness" of the photoreceptor. To ensure consistent output from xerographic apparatus, an assessment of the state of the photoreceptor is very useful.

In addition to the dielectric thickness, the thickness and surface potential of a photoreceptor can be used to assess its state. Thus, measurements of the photoreceptor thickness and surface potential can be used to evaluate and/or stabilize performance in a xerographic marking engine. Robust and more consistent performance can be achieved by varying xerographic control factors based on these measurements. Surface potential and thickness can be measured using electrostatic voltmeters (ESVs) and actual thickness sensors. However, ESVs would be costly to implement, particularly in color xerographic apparatus including multiple photoreceptors and/or marking engines. Instead, such xerographic apparatus typically estimate the condition and thickness of the photoreceptor indirectly by tracking the photoreceptor cycle count and assuming that the photoreceptor wears at a constant rate as a function of cycle count. This assumption tends to be inaccurate, leading to inconsistent performance over the life of a photoreceptor and potentially premature disposal of the photoreceptor. Thus, there is a need for an accurate method of measuring the thickness and/or surface potential of a photoreceptor without using electrostatic voltmeters, actual thickness sensors, or assumptions of wear rate as a function of photoreceptor cycles.

U.S. Pat. No. 6,611,665 to DiRubio et al., incorporated by reference above, discloses a method and apparatus using a biased transfer roll as a dynamic electrostatic voltmeter for system diagnostics and closed loop process controls. While the techniques disclosed in the '665 patent are useful, they can suffer inaccuracies due to unpredictable aging effects of the elastomers used in the BTR, as well as other factors.

Embodiments provide much more accurate measurements by using the biased charging roller to measure both the photoreceptor surface potential ($V_{OPC}$) and the photoreceptor dielectric thickness ($D_{OPC}$). Other current marking engines employ costly Electrostatic Voltmeters (ESVs) to measure the photoreceptor surface potential ($V_{OPC}$) to measure surface potential. In the case of tandem marking engines, which use four photoreceptors as seen, for example, in FIG. 1, at least four ESVs would be required, which increases the cost of the marking engine significantly. Thus, embodiments, by using existing subsystem components to measure photoreceptor surface potential with only minor modifications to the power supply, allow measurement, control, and adjustment with little increased cost.

The measurement routine of embodiments can be run periodically, such as during cycle-up or cycle-down, to ensure consistent output of the xerographic apparatus in which it is used. $V_{OPC}$ is measured in embodiments by operating the biased charging roller in a constant DC current mode and measuring the DC voltage applied to the shaft by the power supply, which will shift in response to $V_{OPC}$. $D_{OPC}$ is measured in embodiments by first charging the photoreceptor with the biased charging roller operated in a DC biased AC mode, then measuring $V_{OPC}$ with the biased charging roller. Preferably, the charging and measuring is repeated for multiple values of AC biased charging roller peak-to-peak voltage ($V_{P-P}$) above and below the bipolar $V_{P-P}$ charging knee. The location of the knee, which is a measure of $D_{OPC}$, can then be calculated. Xerographic process stability is achieved by subsequently adjusting ROS, charging, development, erase, transfer, and other xerographic control factors based on the results of the measurements of $D_{OPC}$ and $V_{OPC}$.

Employing embodiments to directly measure photoreceptor surface potential $V_{OPC}$ using existing hardware in the engine thus enables more advanced process controls and machine self-diagnoses, yet does not significantly increase manufacturing costs and requires only minor modifications to the biased charging roller power supply to add this functionality. The performance of any subsystem that impacts the photoreceptor charge (erase, pre-transfer, transfer, discharge, development etc.) can be evaluated and/or adjusted using subsystem actuators. Likewise, the performance of any subsystem that is impacted by the photoreceptor charge, such as erase, pre-transfer, transfer, discharge, development, and other components, can be evaluated and/or adjusted using subsystem actuators. Additionally, subsystem failures can be detected, allowing the controller to generate an error message or initiate a service call through remote diagnostics. Additionally, automated Photo-Induced Discharge Curves can be generated using embodiments.

Embodiments enable direct measurement of the photoreceptor dielectric thickness, $D_{OPC}$, and therefore the photoreceptor thickness, using existing hardware in the engine. Since many xerographic machines currently use a prediction equation that is based on the number of photoreceptor cycles to estimate OPC dielectric thickness, employing embodiments provides much more accurate thickness determination, which allows more advanced process controls and machine self-diagnoses. Thus, marking system performance can be optimized by adjusting subsystem actuators (development, charge, discharge, transfer, erase, etc.) based on $D_{OPC}$. Further, because photoreceptor/CRUs are currently replaced after a fixed number of cycles, the more accurate measure of $D_{OPC}$ enables a better estimate of photoreceptor age and performance, reducing run cost by potentially reducing the frequency at which the unit is replaced. Other benefits of employing embodiments include improved marking stability and image consistency. Embodiments can be employed cheaply by any engine that uses BCRs. BCRs are widely used in color and black and white office products by all major manufacturers of xerographic engines.

DESCRIPTION

Figure 1:
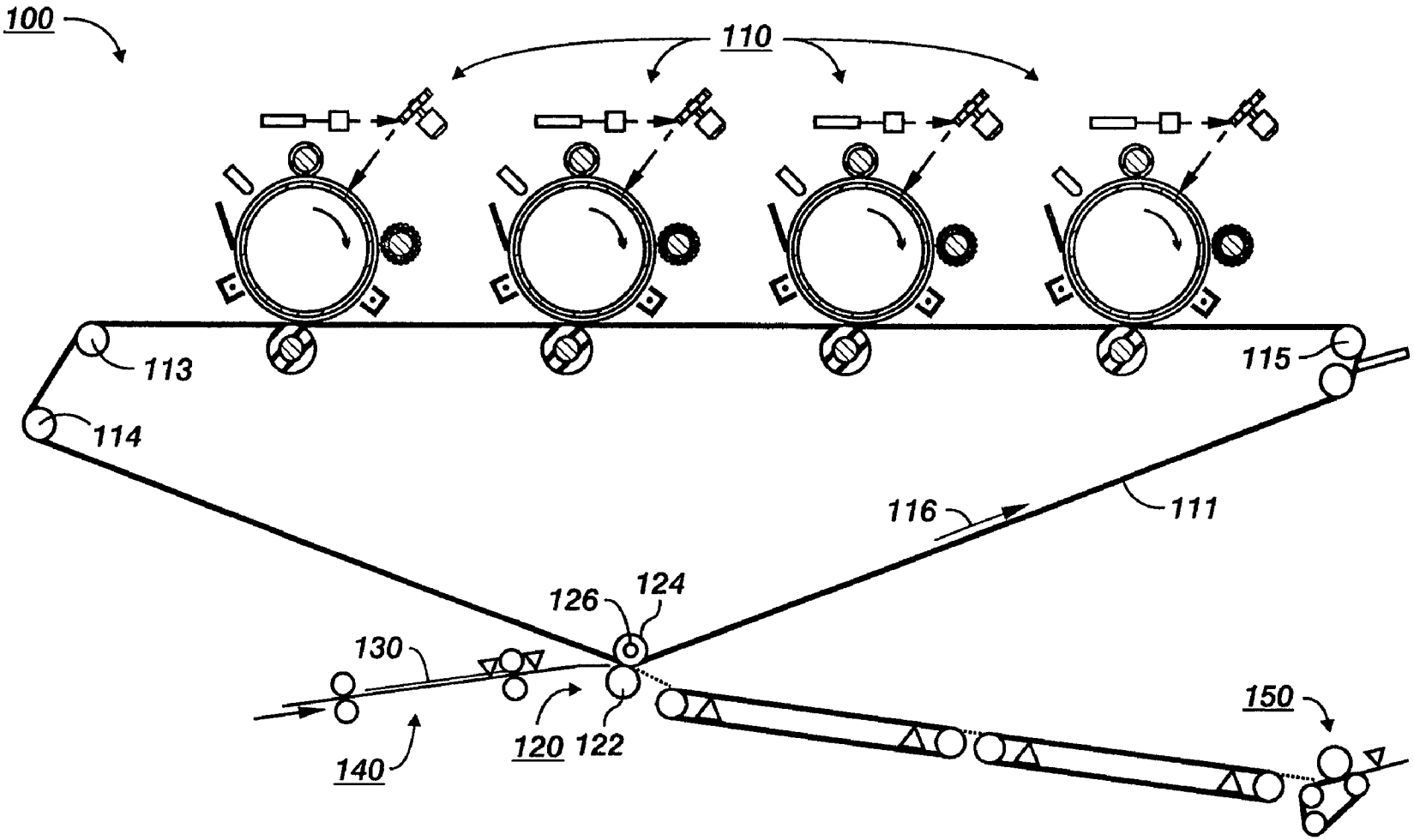
FIG. 1 is a schematic representation of a xerographic apparatus in which embodiments can be employed.

Referring to FIG. 1, a xerographic apparatus 100, such as a copier or laser printer, is shown schematically, incorporating features of embodiments. Although embodiments will be described with reference to the embodiment shown in the drawings, it should be understood that embodiments can be employed in many alternate forms. In addition, any suitable size, shape or type of elements or materials could be used.

As shown in FIG. 1, the xerographic apparatus 100 generally includes at least one image forming apparatus 110, each of substantially identical construction, that can apply a color of toner (or black). In the example of FIG. 1, there are four image forming apparatus 110 which can apply, for example, cyan, magenta, yellow, and/or kappa/black toner. The image forming apparatus 110 apply toner to an intermediate transfer belt 111. The intermediate transfer belt 111 is mounted about at least one tensioning roller 113, steering roller 114, and drive roller 115. As the drive roller 115 rotates, it moves the intermediate transfer belt 111 in the direction of arrow 116 to advance the intermediate transfer belt 111 through the various processing stations disposed about the path of the belt 111. Once the toner image has been completed on the belt 111 by having toner deposited, if appropriate, by each imaging apparatus 110, the complete toner image is moved to the transfer station 120. The transfer station 120 transfers the toner image to paper or other media 130 carried to the transfer station by transport system 140. The media passes through a fusing station 150 to fix the toner image on the media 130. Many xerographic printers 100 use at least one biased transfer roller 124 for transferring imaged toner to sheet-type media 130 as shown and according to embodiments, though it should be understood that embodiments can be employed with continuous rolls of media or other forms of media without departing from the broader aspects of embodiments. U.S. Pat. No. 3,781,105, the disclosure of which is hereby incorporated by reference, discloses some examples of a biased transfer roller that can be used in a xerographic printer.

As shown in FIG. 1, the transfer station 120 includes at least one backup roller 122 on one side of the intermediate transfer belt 111. The backup roller 122 forms a nip on the belt 111 with a biased transfer roller 124 so that media 130 passes over the transfer roller 124 in close proximity to or in contact with the complete toner image on the intermediate transfer belt 111. The transfer roller 124 acts with the backup roll 122 to transfer the toner image by applying high voltage to the surface of the transfer roller 124, such as with a steel roller. The backup roller 122 is mounted on a shaft 126 that is grounded, which creates an electric field that pulls the toner image from the intermediate transfer belt 111 onto the substrate 130. The sheet transport system 140 then directs the media 130 to the fusing station 150 and on to a handling system, catch tray, or the like (not shown).

Alternatively, in embodiments the backup roller 122 can be mounted on a shaft that is biased. As described above, the biased transfer roller 124 is ordinarily mounted on a shaft 126 that is grounded, which creates an electric field that pulls the toner image from the intermediate transfer belt 111 onto the substrate 130. Alternatively, the shaft of the backup roller 122 could be biased while the shaft 126 on the biased transfer roller 124 is grounded. The sheet transport system 140 then directs the media 130 to the fusing station 150 and on to a handling system, catch tray, or the like (not shown).

Figure 2:
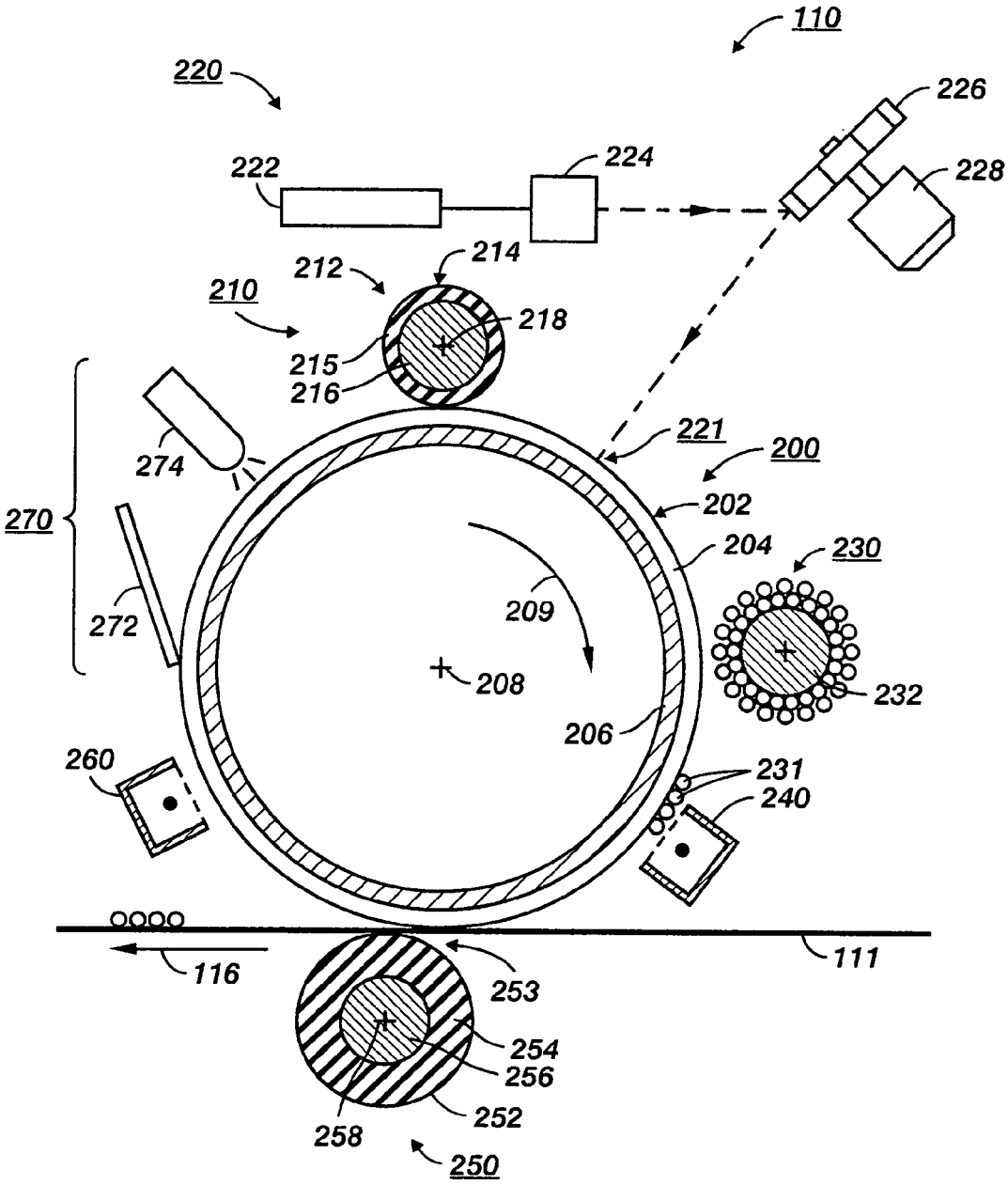
FIG. 2 is a schematic of an imaging apparatus in which embodiments can be employed, the imaging apparatus being part of a xerographic apparatus, such as that shown in FIG. 1.

Referring to one image forming apparatus 110 as an example, shown in FIG. 2, each image forming apparatus 110 includes a photoreceptor 200 (also referred to as OPC), a charging station or subsystem 210, a laser scanning device or subsystem 220, such as a rasterizing output scanner (ROS), a toner deposition/development station or subsystem 230, a pretransfer station or subsystem 240, a transfer station or subsystem 250, a precleaning station or subsystem 260, and a cleaning/erase station 270. The photoreceptor 200 of embodiments is a drum, but other forms of photoreceptor could conceivably be used. The photoreceptor drum 210 of embodiments includes a surface 202 of a photoconductive layer 204 on which an electrostatic charge can be formed. The photoconductive layer 204 behaves like a dielectric in the dark and a conductor when exposed to light The photoconductive layer 204 can be mounted or formed on a cylinder 206 that is mounted for rotation on a shaft 208, such as in the direction of the arrow 209.

Figure 3:
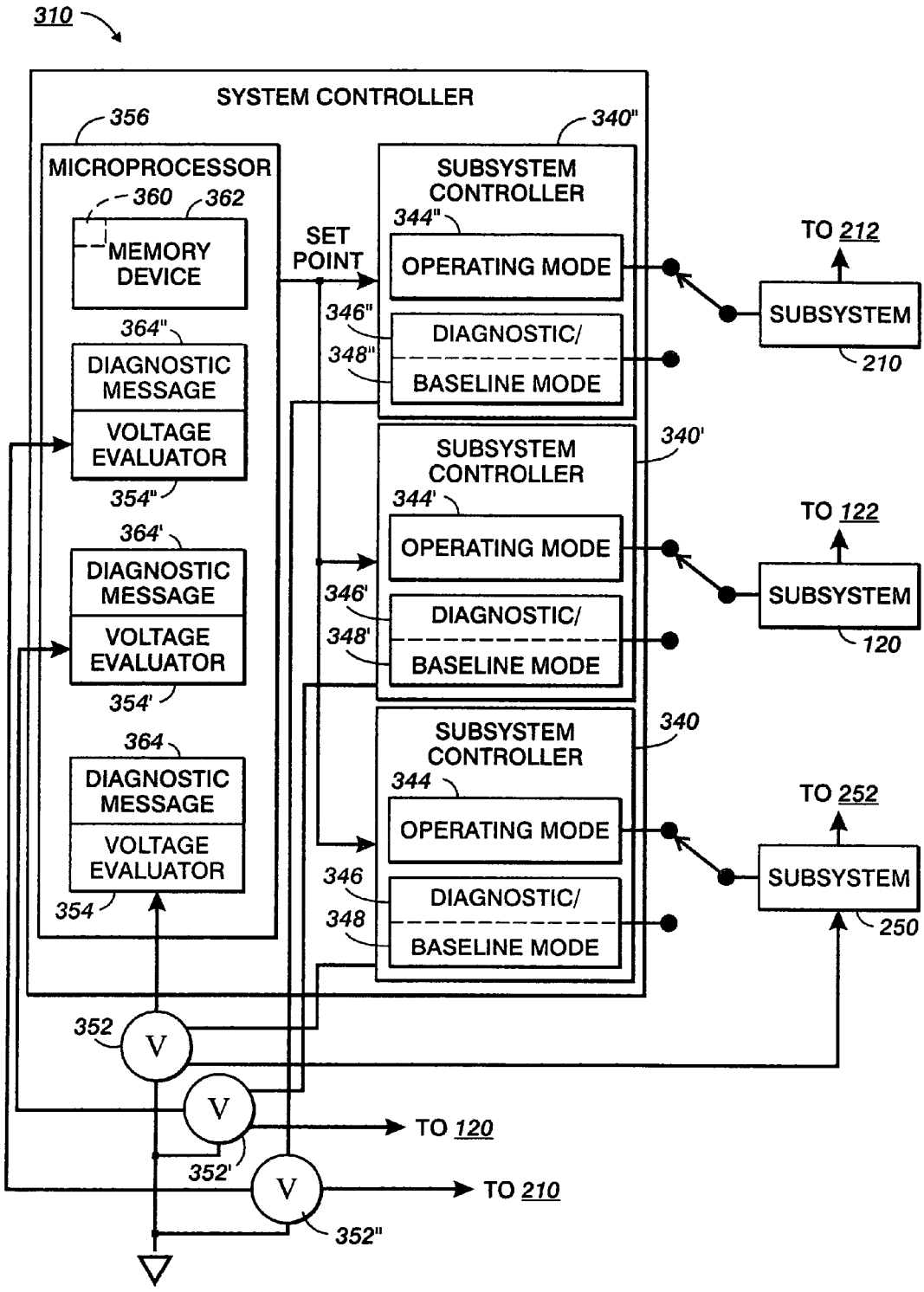
FIG. 3 is a schematic of the components employed in embodiments.

The charging station 210 of embodiments includes a biased charging roller 212 that charges the photoreceptor 200 using a DC-biased AC voltage supplied by a high voltage power supply (shown in FIG. 3). The biased charging roller 212 includes a surface 214 of one or more elastomeric layers 215 formed or mounted on an inner cylinder 216, such as a steel cylinder, though any appropriate material could be used. The roller 212 is preferably mounted for rotation with a shaft 218 extending therethrough along a longitudinal axis of the roller 212.

The laser scanning device 220 of embodiments includes a controller 222 that modulates the output of a laser 224, such as a diode laser, whose modulated beam shines onto a rotating mirror or prism 226 rotated by a motor 228. The mirror or prism 226 reflects the modulated laser beam onto the charged OPC surface 202, panning it across the width of the OPC surface 202 so that the modulated beam can form a line 221 of the image to be printed on the OPC surface 202. In this way a latent image is created by selectively discharging the areas which are to receive the toner image. Drawn portions of the image to be printed move on to the toner deposition station 230, where toner 232 adheres to the drawn/discharged portions of the image. The drawn portions of the image, with adherent toner, then pass to the pretransfer station 240 and on to the transfer station 250. The pre-transfer station 240 is used to adjust the charge state of the toner and photoreceptor in order to optimize transfer performance.

The transfer station 250 includes a biased transfer roller 252 arranged to form a nip 253 on the intermediate transfer belt 111 with the OPC 200 for transfer of the toner image onto the intermediate transfer belt 111. In embodiments, the biased transfer roller 252 includes one or more elastomeric layers 254 formed or mounted on an inner cylinder 256, and the roller 252 is mounted on a shaft 258 extending along a longitudinal axis of the roller 252. The biased transfer roller 252 carries a DC potential provided by a high voltage power supply 352, such as that seen in FIG. 3. The voltage applied to the roller 252 draws the toner image 231 from the photoreceptor surface 202 to the intermediate transfer belt 111. After transfer, the OPC surface 202 rotates to the precleaning subsystem 260, then to the cleaning/erasing substation 270, where a blade 272 scrapes excess toner from the OPC surface 202 and an erase lamp 274 reduces the static charge on the OPC surface.

Referring to FIG. 3, an electronic control system 310 for the xerographic apparatus 100 can include at least one subsystem controller connected to at least one respective subsystem. In the example shown in FIG. 3, three subsystem controllers 340, 340', 340" are connected to a local transfer subsystem 250, the main transfer subsystem 120, and a charging subsystem 210, respectively. Each of the at least one subsystem controller 340, 340', 340" of embodiments includes an operating mode apparatus 344, 344', 344" and apparatus to selectively operate in diagnostic mode 346, 346', 346" and baseline mode 348, 348', 348". The controller 310 further includes a microprocessor 356 that can include a memory device 360 and can produce a diagnostic message 364, 364', 364" in response to code and to a voltage evaluator 354, 354', 354". The diagnostic message can be displayed on a user interface (not shown) of the xerographic apparatus. The microprocessor 356 is preferably connected to high voltage power supplies 352, 352', 352" for first transfer subsystem 250, second transfer subsystem 120, and the charging subsystem 210, respectively. One power supply delivers a control current and/or control voltage to the biased transfer roller 122 of the main transfer subsystem, another power supply delivers a control current and/or control voltage to one or each biased charging roller 212, and another power supply delivers a control current and/or control voltage to one or each local biased transfer roller 252. The biased charging roller 212 is often powered by a DC biased, AC high voltage power supply 352". The DC component provided to the biased charging roller 212 is typically maintained at a constant controlled voltage, while the AC component is typically operated at a constant controlled current. The biased transfer roller 252 is often powered by a DC high voltage power supply 352' that is operated in either constant controlled current or constant controlled voltage mode. The voltage or current set point(s) of either the charging or transfer roller can be varied over time.

Embodiments, as seen in FIGS. 9-12, can use the biased charging roller (BCR) 212 to measure both the photoreceptor surface 202 potential ($V_{OPC}$) and the photoreceptor dielectric 204 thickness ($D_{OPC}$). The OPC potential, $V_{OPC}$, can be determined by operating the BCR in a constant DC current mode and measuring the DC voltage applied to the shaft 218 by the power supply. The voltage on the shaft 218 will shift in response to $V_{OPC}$, and this shift can be used to determine the value of the OPC voltage, thus using the BCR as an electrodynamic voltmeter.

More specifically, according to a simple analytic model for a DC biased charging roller, the voltage on the BCR 212 is directly proportional to the potential on the photoreceptor surface 202. Mathematically, this is represented as $\Delta V_{BCR} \propto \Delta V_{OPC}{}^{0}$, where $V^{0}{}_{OPC}$ is the photoreceptor surface potential entering the biased charging roller nip, and $V_{BCR}$ is the voltage applied to the biased charging roller 212 when operated in constant DC current mode. Since the two values are directly proportional, a shift in biased charging roller power supply voltage will be proportional to a shift in photoreceptor surface potential.

The full equation relating $V_{BCR}$ to $V^{0}{}_{OPC}$ depends whether the biased charging roller 212 is operated in a negative or positive charging mode. When the BCR 212 is operated in a negative charging mode, the equation is:

$$V_{OPC}^{0} = V_{BCR} + V_{TH} - \frac{I_{BCR}}{\beta}, \tag{1}$$

but when the BCR 212 is operated in a positive charging mode, the equation is:

$$V_{OPC}^{0} = V_{BCR} - V_{TH} - \frac{I_{BCR}}{\beta}. \tag{2}$$

In both cases, $V_{TH}$ is the voltage threshold for air breakdown, and $\beta$ is determined by:

$$\beta = \frac{\varepsilon_0 L_{BCR} v_{process}}{D_{OPC}}, \tag{3}$$

where $D_{OPC}$ is the photoreceptor dielectric thickness, which can be determined by dividing the actual thickness d by the dielectric constant k of the dielectric layer (d/k). $L_{BCR}$ is the length of the biased charging roller inboard to outboard, $v_{process}$ is the process speed, and $\epsilon_0$ is the permittivity of free space. The threshold for air breakdown is given by:

$$V_{TH}=312+87.96\sqrt{D_{OPC}}+6.2D_{OPC}, \tag{4}$$

which assumes that the charge relaxation within the biased charging roller elastomer 214 is fast compared to the dwell time in the nip, and that $D_{OPC}$ is entered into the equation in units of microns.

Figure 11:
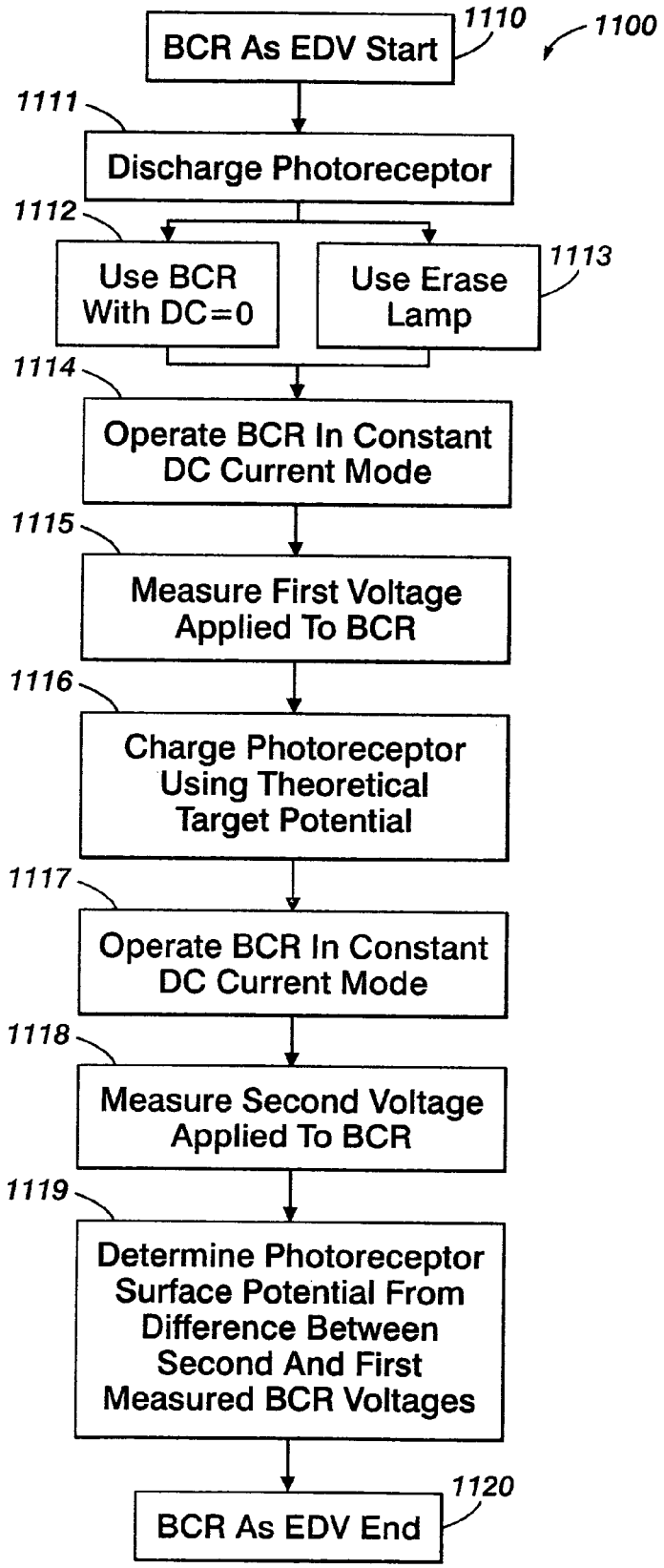
FIG. 11 is a schematic flow diagram of a method of using a biased charging roller as an electrodynamic voltmeter according to embodiments.

With particular reference to the schematic flow diagram shown in FIG. 11, a method of using a BCR as an EDV 1100 can start (box 1110) by fully discharging the photoreceptor 1111 so that $V^{0}{}_{OPC}=0$. This can be done with the erase lamp 274 (box 1113). Alternatively, this can be achieved by charging the OPC surface 202 with the biased charging roller 212 operated in normal DC-biased AC mode with $V_{BCR,DC}=0$ (box 1112). Once the photoreceptor potential is zeroed, embodiments operate the biased charging roller 212 in constant DC current mode (box 1114) and measure a first voltage, $V_{BCR1}$, applied to the shaft 218 by the power supply 352 (box 1115). Embodiments then charge the photoreceptor surface 202 to the value required by the operating conditions that are to be tested (box 1116) and again operate the biased charging roller 212 in constant DC current mode (box 1117). A second voltage, $V_{BCR2}$, applied to the shaft 218 by the power supply 352 is measured (box 1118), the second voltage being representative of the operating conditions being tested. Embodiments then determine the actual photoreceptor potential, $V^0_{OPC}$, by subtracting the first voltage from the second voltage (box 1119), thus:

$$V_{OPC}^0=V_{BCR2}-V_{BCR1}=\Delta V_{BCR}, \tag{5}$$

after which the method can end (box 1120). Due to non-ideal performance, $V^0_{OPC}$ may not be strictly proportional to $\Delta V_{BCR}$ with a slope of 1. In that case, a calibration curve can be used to calculate $V^0_{OPC}$ from measurements of $V_{BCR1}$ and $V_{BCR2}$.

Figure 4:
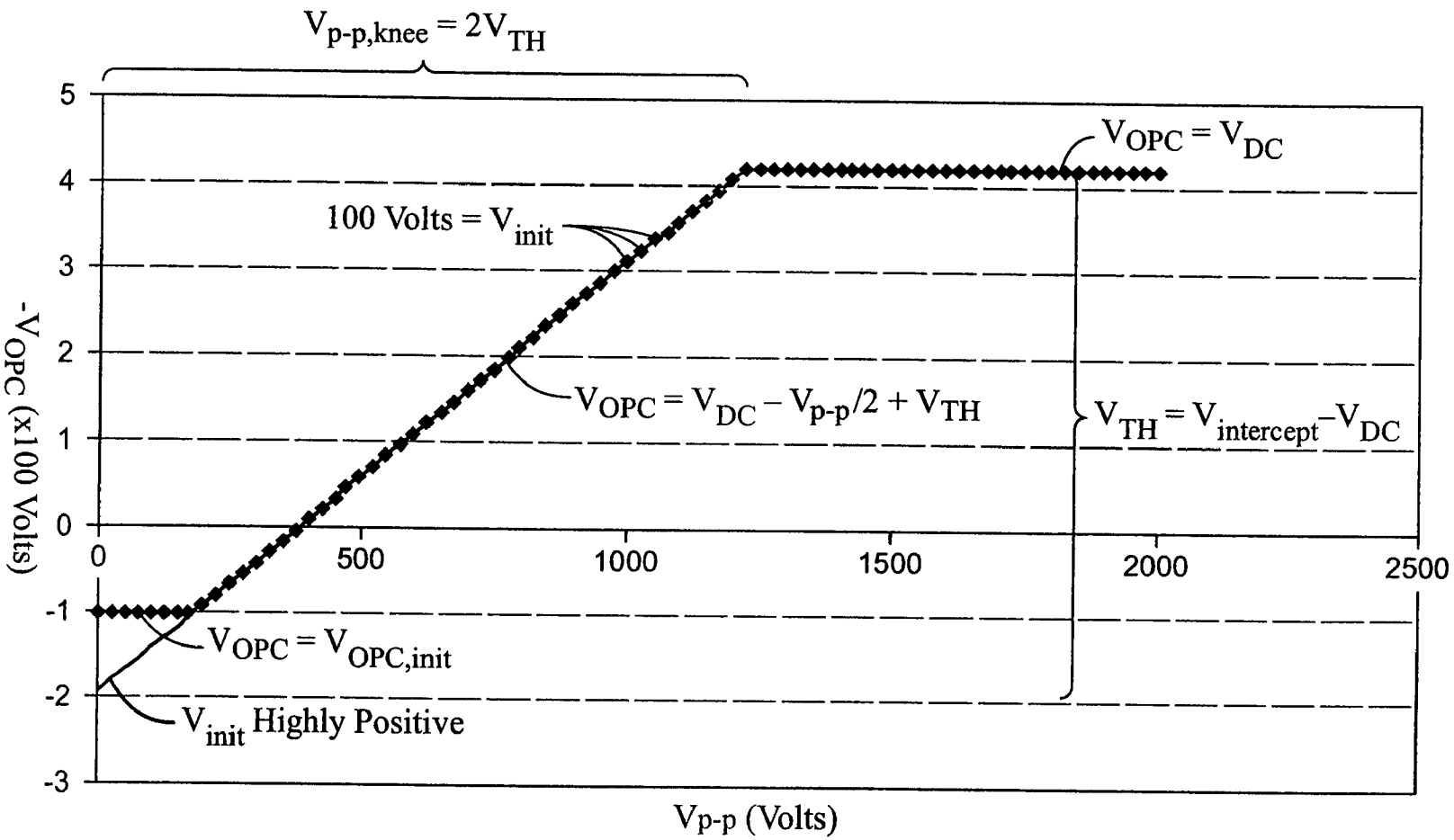
FIG. 4 is a graph of photoreceptor surface potential versus peak-to-peak bias charging roller voltage, $V_{p-p}$.
Figure 9:
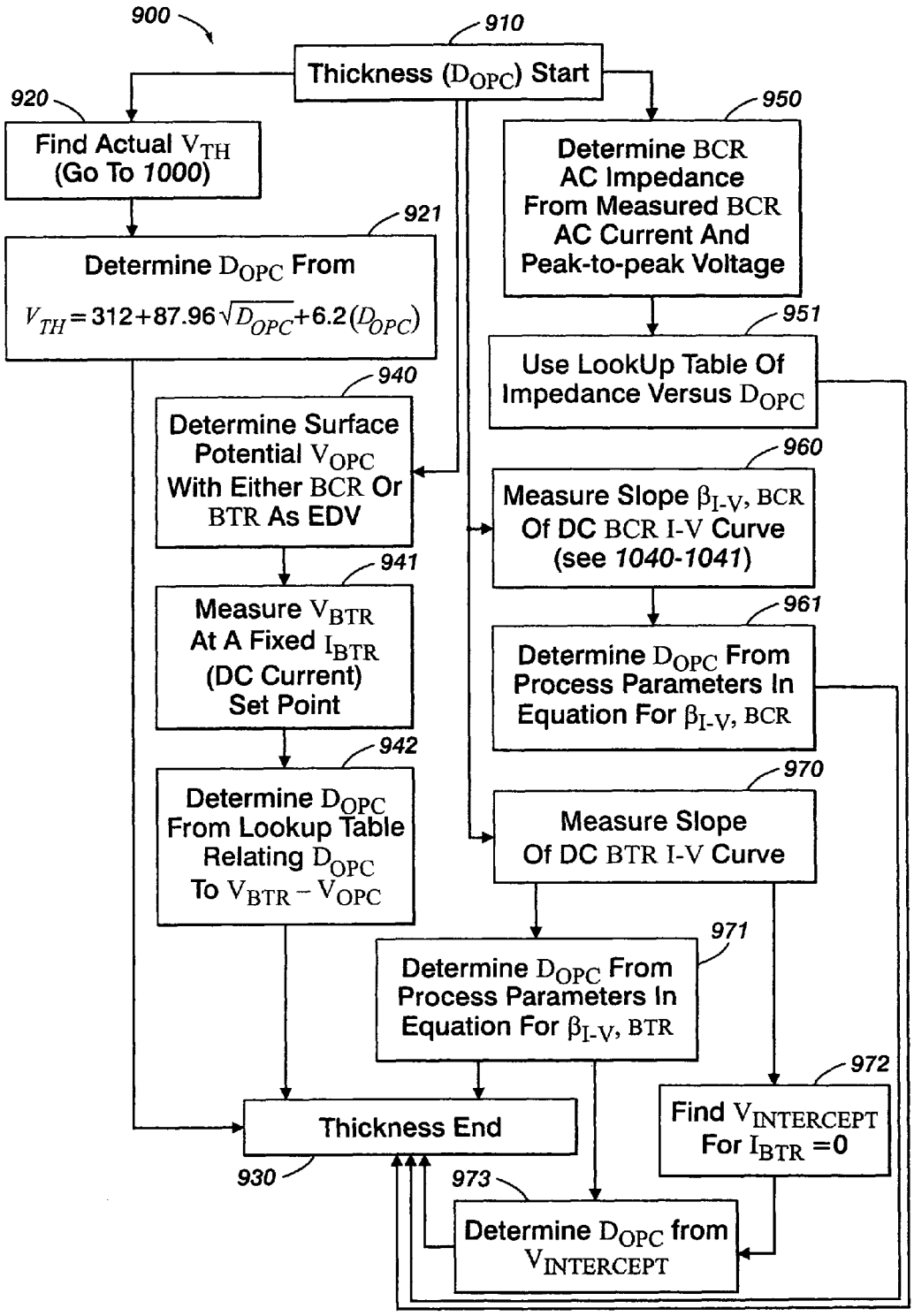
FIG. 9 is a schematic flow diagram of a method of determining photoreceptor dielectric thickness according to embodiments.

To explain a method of determination of the dielectric thickness 900 according to embodiments, an embodiment of which is shown in FIG. 9, it is helpful to consider the behavior of the surface voltage of the photoreceptor with respect to other xerographic process variables. For example, consider the characteristic charging curve for an AC biased charging roller, a graph of photoreceptor surface voltage versus the AC peak-to-peak voltage of the biased charging roller voltage component, as seen in FIG. 4. The curve has no slope until the threshold voltage, $V_{TH}$, is exceeded by the absolute value of the difference between the maximum applied voltage and the initial OPC surface voltage entering the nip. Mathematically this is expressed as:

$$|V_{OPC}^0-(V_{DC}-V_{P\text{-}P}/2)|>V_{TH} \tag{6}$$

if the photoreceptor surface is being charged negatively. Once this condition has been met, the $V_{OPC}$ increases with a constant slope until a maximum OPC voltage is achieved, after which point increasing the peak-to-peak voltage of the charging roller does not change the OPC surface voltage, and $V_{OPC}=V_{DC}$. This point of transition from a slope to maximum OPC voltage is a "knee" in the curve and is typically equal to the DC voltage applied to the charging roller. Embodiments capitalize on the newly-discovered substantially linear, or at least monotonic, relationship between the knee value of the peak-to-peak BCR voltage and the thickness of the photoreceptor dielectric layer 204 to determine the thickness and dielectric thickness of the dielectric layer 204 of the photoreceptor 200.

In the simplest models the high voltage knee in the $V_{OPC}$ vs. $V_{P\text{-}P}$ curve is equal to $2*V_{TH}$, where $V_{TH}$, the threshold for air breakdown, is determined by:

$$V_{TH}=\frac{312+87.96}{\sqrt{D_{OPC}+D_{BCREQ}}}+6.2(D_{OPC}+D_{BCREQ}), \tag{7}$$

where $D_{OPC}$ is the dielectric thickness of the photoreceptor and $D_{BCR,EQ}$ is the equivalent dielectric thickness of the biased charging roller. Typically, $D_{BCR,EQ}$ is much less than $D_{OPC}$ and can be ignored so that a measurement of $V_{TH}$ becomes a direct measure of the photoreceptor dielectric thickness as seen in equation (4). In the event that $D_{BCREQ}$ is both significant and temperature and RH dependent, the techniques illustrated below can still be applied, but $D_{BCREQ}$ would need to be determined independently. This could be done by measuring the temperature and RH of the cavity with sensors and using this information to select a value for $D_{BCREQ}$ from a look-up table (located in CPU memory) to use in equation (7). Such a measurement of the threshold voltage can be achieved with a method 1000 such as that seen in FIG. 10 as will be discussed below. As outlined above, the biased charging roller can be used as an electro-dynamic voltmeter 1100 to measure the photoreceptor surface voltage, $V_{OPC}$, for a plurality of values of the peak-to-peak voltage, $V_{P\text{-}P}$, below 1020 and above the knee 1023. Of course, if the xerographic apparatus is equipped with an ESV, the ESV can be used to conduct these measurements of photoreceptor surface potential 1021. Best fit lines are determined for each set of values 1022, 1025, and the intersection point of the best fit lines determines the location of the knee 1026. Once the location of the knee is known, the threshold voltage $V_{TH}$, and therefore the photoreceptor dielectric thickness, $D_{OPC}$, can be determined 1027.

A method for determining the photoreceptor dielectric thickness, $D_{OPC}$, 900 according to embodiments, seen, for example, in FIG. 9, can therefore include finding the threshold voltage 920, such as with the method 1000 shown in FIG. 10, which will be discussed below. Once the threshold voltage is known, embodiments proceed by determining the dielectric thickness, $D_{OPC}$, directly from the threshold voltage, $V_{TH}$, using equation (7) 921, at which point the determination of dielectric thickness ends 930. Embodiments can include determining the actual thickness of the photoreceptor from $d_{OPC}=D_{OPC}*k$, where k is the dielectric constant of the photoreceptor. If the system exhibits non-ideal performance, then a calibration curve can be used to calculate $D_{OPC}$ and/or $d_{OPC}$ from $V_{TH}$.

In embodiments, again referring to FIG. 9, the threshold voltage need not be determined. Rather, the method of dielectric thickness determination can begin 910 by a measuring surface potential with the BCR or BTR, such as by determining the surface potential $V_{OPC}$ 940 with the same procedure used on the biased charging roller above, and measuring BTR voltage $V_{BTR}$ at a fixed value of BTR current $I_{BTR}$ 941, then using the difference between BTR voltage and surface potential as a measure of dielectric thickness 942 since $V_{BTR}-V_{OPC}$ increases monotonically as $D_{OPC}$ increases. For example, a lookup table of dielectric thickness versus voltage difference can be used to convert $V_{BTR}-V_{OPC}$ to $D_{OPC}$. The table can also use temperature and RH information to reduce the noise and inaccuracies introduced by variation in the BTR equivalent dielectric thickness $D_{BTR,EQ}$ and the ITB (Intermediate Transfer Belt) dielectric thickness $D_{ITB,EQ}$.

Figure 7:
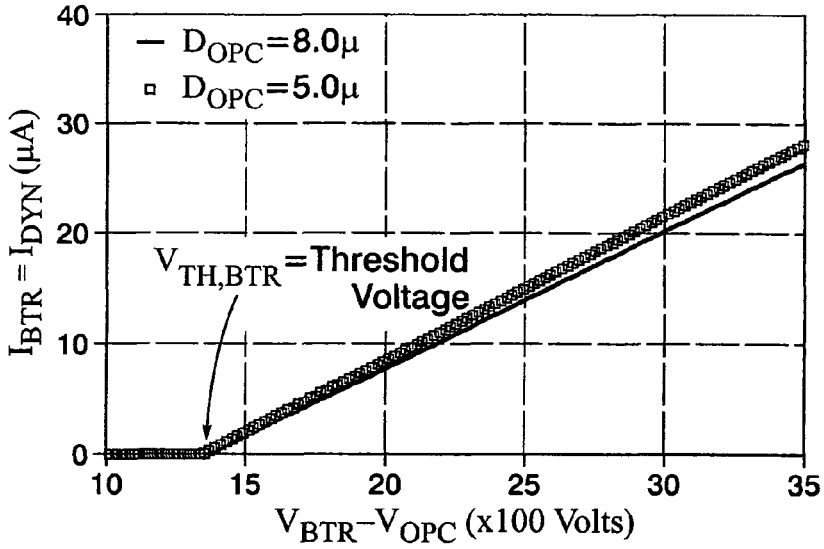
FIG. 7 is a graph of biased transfer roller current versus the difference between biased transfer roller voltage and photoreceptor surface potential.
Figure 8:
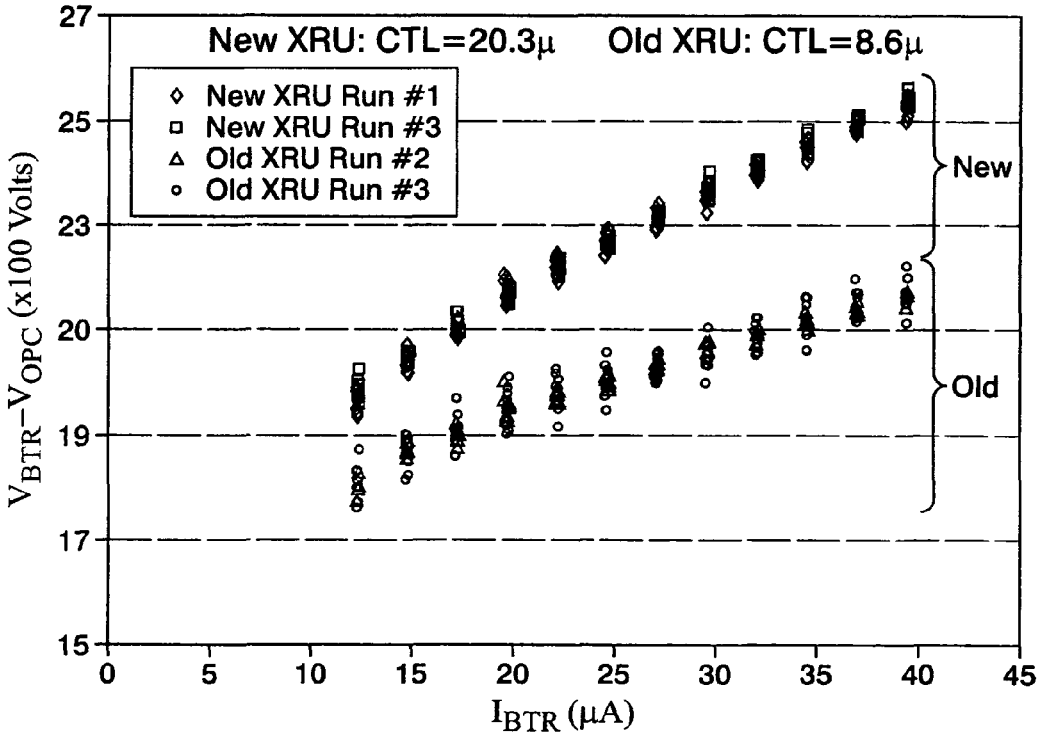
FIG. 8 is a graph of experimental values of the difference between biased transfer roller voltage and photoreceptor surface potential on the vertical axis versus biased transfer roller current on the horizontal axis showing two sets of data points corresponding to two known photoreceptor thicknesses.

Alternatively, the photoreceptor dielectric thickness can be determined by measuring the slope of the dynamic I-V (current versus voltage difference, $I_{BTR}$ vs. $V_{BTR}-V_{OPC}$) curve, such as that shown in FIG. 7, above the BTR threshold voltage $V_{TH,BTR}$. $V_{TH,BTR}$ is defined here as the $I_{BTR}=0$ intercept of the BTR dynamic I-V curve. By measuring two or more points above the BTR threshold voltage of the dynamic I-V curve, while holding $V_{OPC}$ constant, the slope can be determined. If $V_{OPC}$ is measured at each point with either the BCR, BTR, or an ESV, then the BTR threshold voltage can be determined from the $I_{BTR}=0$ intercept of a straight line fit to the BTR dynamic I-V curve. The BTR threshold voltage, $V_{TH,BTR}$, and slope of the dynamic IV curve are both a function of total dielectric thickness, thus:

$$\Sigma D=D_{OPC}+D_{ITB,EQ}+D_{BTR,EQ}, \tag{8}$$

where $D_{ITB,EQ}$ is the equivalent dielectric thickness of the relaxable intermediate transfer belt and $D_{BTR,EQ}$ is the equivalent dielectric thickness of the relaxable BTR. $D_{BTR,EQ}$ will be the dominant term in a typical engine, so this technique may be sensitive to shifts in this term due to resistivity shifts in the BTR elastomer induced by aging, temperature shifts, and relative humidity shifts. The sensitivity of this technique to $D_{OPC}$, the quantity we wish to measure, is borne out by experiments, the results of which are shown in a corresponding voltage difference versus BTR current curve in FIG. 8. Thus, $D_{OPC}$ can be extracted from the BTR current vs. voltage characteristic curve ($I_{BTR}$ vs $V_{BTR}-V_{OPC}$) in at least three ways. The slope of the curve can be measured 970 and used with process parameters to determine the dielectric thickness 971. Additionally, the $I_{BTR}=0$ intercept (BTR threshold voltage, $V_{TH,BRT}$) can be measured 972 and used to determine the dielectric thickness 973. Further, the difference $V_{BTR}-V_{OPC}$ can be measured at a fixed $I_{BTR}$. as disclosed above with respect to blocks 940-943. The sensitivity of all three features of the characteristic curve to $D_{OPC}$ is illustrated by the analytical modeling results shown in FIG. 7.

Figure 6:
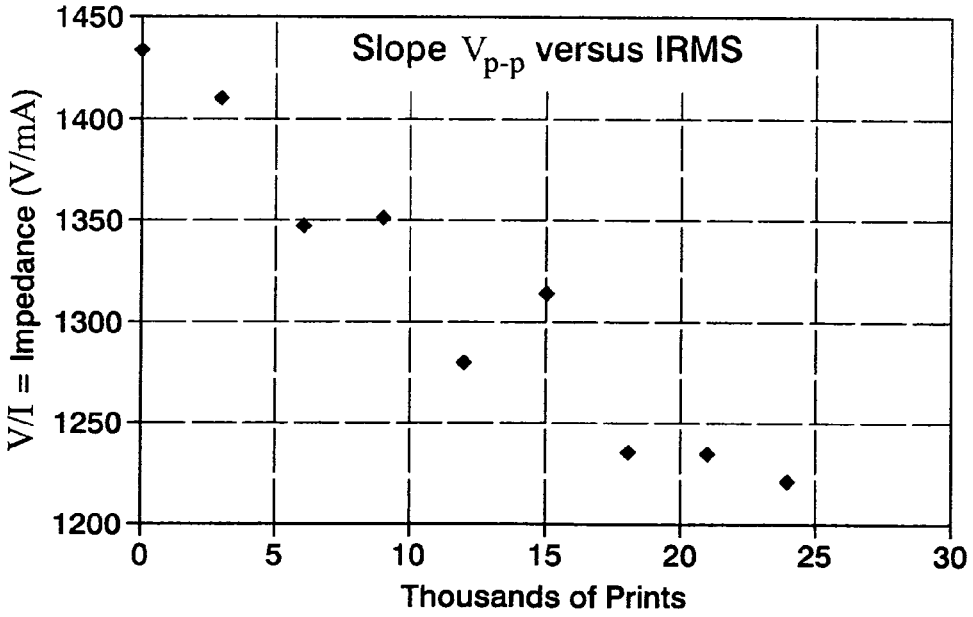
FIG. 6 is a graph of the slope of the biased charging roller AC impedance versus number of prints completed by the photoreceptor.

As also seen in FIG. 9, another method of determining thickness without determining threshold voltage includes determining the BCR impedance 950. This alternative for determining the dielectric thickness, $D_{OPC}$, comprises measuring the slope of the peak-to-peak voltage versus AC current curve ($V_{P-P}$ vs. $I_{AC}$ curve). This is generally a noisier, less accurate measurement method than the technique and alternatives described above. The slope of this curve provides the impedance of the BCR and is generally linearly related to the photoreceptor dielectric thickness, $D_{OPC}$. For example, in FIG. 6 the AC slope/impedance is plotted for a biased charging roller charging a photoreceptor as a function of print count. Since the dielectric thickness ideally decreases monotonically with print count, this curve illustrates the sensitivity of the slope/impedance to $D_{OPC}$. The procedure, according to embodiments, includes operating the BCR in constant AC voltage or AC constant current mode, measuring the AC current or voltage at two or more voltage or current set-points, (determining the slope of the line from the measured data, and deducing $D_{OPC}$ from a look-up table, such as by measuring BCR AC current and peak-to-peak voltage, and employing a relationship between the impedance and the thickness 951, such as with a lookup table.

Another alternative method for determining dielectric thickness includes measuring the slope β of the BCR DC I-V curve 960 as outlined above and determining the dielectric thickness using the slope β, process parameters, and equation (3) above 961.

As outlined above, the method of using a biased charging roller as an electro-dynamic voltmeter 1100 can be used to measure the photoreceptor surface voltage, $V_{OPC}$, for a plurality of values of the peak-to-peak voltage, $V_{P-P}$, below 1020 and above the knee 1023. Of course, if the xerographic apparatus is equipped with an ESV, the ESV can be used to conduct these measurements of photoreceptor surface potential 1021. Best fit lines are determined for each set of values 1022, 1025, and the intersection point of the best fit lines determines the location of the knee 1026. Once the location of the knee is known, the threshold voltage $V_{TH}$, and therefore the photoreceptor dielectric thickness, $D_{OPC}$, can be determined 1027.

It should be noted that the biased charging roller acting as an electro-dynamic voltmeter will work best when the photoreceptor has a constant surface potential in the cross process direction. Thus, the BTR, erase, development, and discharge are preferably disabled during these measurements in embodiments.

Figure 5:
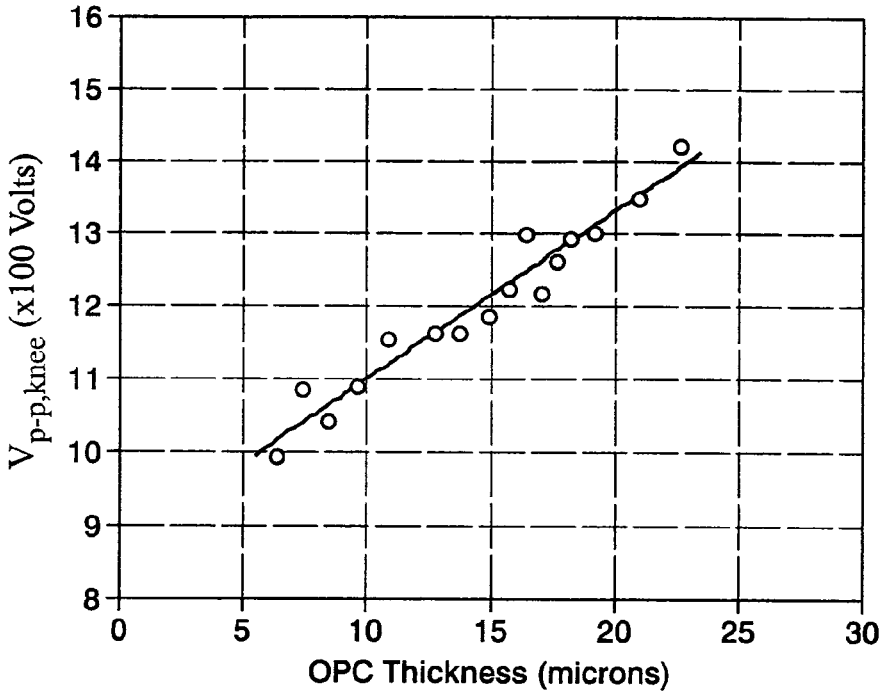
FIG. 5 is a graph of the knee value of $V_{p-p}$ versus photoreceptor thickness.

FIG. 5 shows a graph of knee value versus photoreceptor thickness determined by actual experiments to confirm the relationship. The photoreceptor thickness was measured using an eddy current probe, and the location of the knee was determined using the procedure described above. The graph shows a clear correlation between the location of the knee ($V_{P-P,KNEE}$) and the photoreceptor thickness, confirming the validity of the method of embodiments.

As an alternative to finding the intersection point of the best fit lines as described above, referring again to FIG. 10, the threshold voltage, $V_{TH}$, values can instead be measured by determining the y-intercept of the sloped portion (below the knee) of the photoreceptor surface voltage vs. peak-to-peak voltage curve 1028. In this alternative, according to embodiments, the method need only measure the surface voltage for a plurality of points below the knee 1020, then find a best fit line 1022 and determine the intercept value on the surface voltage axis 1028. The intercept value, $V_{OPC\ (intercept)}$, can then be used to find the threshold voltage using the formula $V_{TH}=V_{OPC\ (intercept)}-V_{DC}$ 1029, where $V_{DC}$ is the DC bias applied to the biased charging roller shaft.

Figure 10:
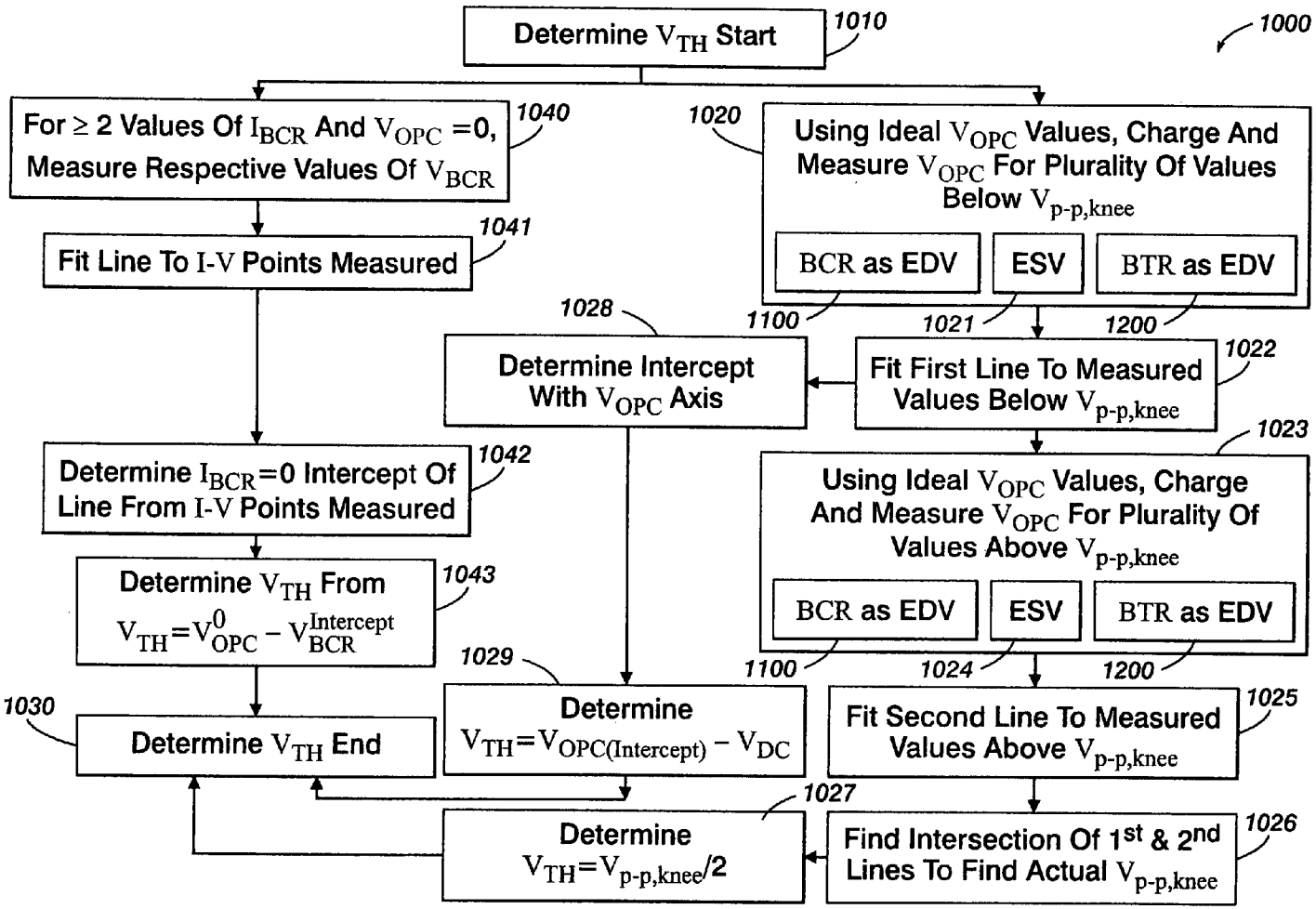
FIG. 10 is a schematic flow diagram of a method of determining threshold voltage according to embodiments.

As another alternative, again seen in FIG. 10, the threshold voltage and dielectric thickness can be measured by operating the biased charging roller in a purely DC mode, measuring values of the BCR voltage for at least two values of BCR current while holding the photoreceptor potential $V_{OPC}^0$ at zero 1040. As described above in the section on using a biased charging roller to measure the photoreceptor surface potential, $V_{OPC}$, $V_{OPC}$ is linearly related to the biased charging roller current, $I_{BCR}$, according to equation (2), above and as follows:

$$V_{OPC}^0 = V_{BCR} + V_{TH} - \frac{I_{BCR}}{\beta}, \tag{2}$$

or restated as $$I_{BCR}=\beta(V_{BCR}+V_{TH}-V_{OPC}^0) \tag{9}$$

If $I_{BCR}$ and $V_{BCR}$ are measured at two or more values by the power source with the photoreceptor discharged so that $V_{OPC}^0=0$, then a line can be fit to the measured points 1041, and the slope β can be determined from a straight line fit 1042. The threshold voltage can then be determined according to equation (9) 1043. Again, $V_{OPC}^0$ should be held constant, e.g. 0 volts, for each power source value in the above procedure, according to the preferred embodiments. Thus, embodiments include charging the OPC to a known value, preferably 0 volts, setting the DC power supply to a first current value $I_{BCR}$, and measuring $V_{BCR}$. Embodiments preferably also include repeating the setting of a current value for one or more additional, different values of $I_{BCR}$, calculating a straight line fit to equation (2), determining the slope, β, and calculating the dielectric thickness of the OPC, $D_{OPC}$, directly from the slope β. Alternatively, the threshold voltage can be determined from the $I_{BCR}=0$ intercept ($V_{TH}=V_{OPC}^0-V_{BCR}^{INTERCEPT}$) of the straight line fit to equation (8) and the photoreceptor dielectric thickness, $D_{OPC}$, can be determined from the threshold voltage 920. Note that although setting $V_{OPC}^0=0$ is preferred, it is not necessary. $V_{TH}$ can be determined from either the slope or the intercept if, in addition to $V_{BCR}$, $V_{OPC}^0$ is measured at each current setpoint. $V_{OPC}^0$ would preferably be measured by an ESV or some other device that does not alter the charge on the photoreceptor during the measurement process.

Once the dielectric thickness of the photoreceptor is known, the output of the xerographic machine can be optimized, such as by subsequently adjusting ROS, charging, development, erase, transfer, and other xerographic control factors. Variants determine the threshold voltage using the y-intercept of the $V_{OPC}$ vs. $V_{p-p}$ curve, or from a relationship between BCR current, BCR voltage and photoreceptor surface potential. An additional variant eliminates the determination of threshold voltage by relying on the monotonic relationship between the impedance of the BCR and the number of prints made by the photoreceptor.

Employing embodiments to directly measure photoreceptor surface potential $V_{OPC}$ using existing hardware in the engine enables more advanced process controls and machine self-diagnoses, yet does not significantly increase manufacturing costs and requires only minor modifications to the biased charging roller power supply to add this functionality. The performance of any subsystem that impacts the photoreceptor charge (erase, pre-transfer, transfer, discharge, etc.) can be evaluated and/or adjusted using subsystem actuators. Subsystem failures can be detected, allowing the controller to generate an error message or initiate a service call through remote diagnostics.

Embodiments enable direct measurement of the photoreceptor dielectric thickness, $D_{OPC}$, and therefore the photoreceptor thickness, using existing hardware in the engine. Since many xerographic machines currently use a prediction equation that is based on the number of photoreceptor cycles to estimate OPC dielectric thickness, employing embodiments provides much more accurate thickness determination, which allows more advanced process controls and machine self-diagnoses. Thus, marking system performance can be optimized by adjusting subsystem actuators (development, charge, discharge, transfer, erase, etc.) based on $D_{OPC}$. Further, because photoreceptor/CRUs are currently replaced after a fixed number of cycles, the more accurate measure of $D_{OPC}$ enables a better estimate of photoreceptor age and performance, reducing run cost by potentially reducing the frequency at which the unit is replaced. Other benefits of employing embodiments include improved marking stability and image consistency. Embodiments can be employed cheaply by any engine that uses BCRs. BCRs are widely used in color and black and white office products by all major manufacturers of xerographic engines. Marking engines that use BTRs for transfer, but do not utilize BCRs for charging, can still benefit from this invention since $V_{OPC}$ can be measured by the BTR as taught in the '665 patent, and $D_{OPC}$ can be measured using the BTR as taught in this application.

It will be appreciated that various of the above-disclosed and other features and functions, or alternatives thereof, may be desirably combined into many other different systems or applications. It will also be noted that various presently unforeseen or unanticipated alternatives, modifications, variations or improvements therein may be subsequently made by those skilled in the art which are also intended to be encompassed by the following claims.

What is claimed is:

1. In a xerographic apparatus including a photoreceptor, a photoreceptor charging subsystem, an imaging subsystem, and a transfer subsystem, a photoreceptor thickness determination method comprising finding a threshold voltage, and determining the dielectric thickness according to a relationship between threshold voltage and dielectric thickness and determining a slope of a curve representing the variation of voltage with current in a component of one of the charging and the transfer subsystems in which a measure of the threshold voltage is a measure of the dielectric thickness of the photoreceptor.

2. The method of claim 1 wherein finding the threshold voltage comprises:

charging the photoreceptor with a target potential below a peak-to-peak voltage knee;

measuring the actual surface potential;

repeating charging and measuring to obtain a plurality of actual surface potential points below the knee; and fitting a first line to the plurality of points below the knee.

3. The method of claim 2 further comprising determining an intercept value of the first line with a surface potential axis located at a particular value of peak-to-peak voltage in a surface potential versus peak-to-peak voltage space and determining the threshold voltage as a difference between the intercept value and a DC voltage applied to a component of the charging subsystem.

4. The method of claim 2 further comprising:

charging the photoreceptor with a target potential above the peak-to-peak voltage knee;

measuring the actual surface potential;

repeating charging and measuring to obtain a plurality of actual surface potential points above the knee;

fitting a second line to the plurality of points above the knee;

finding an intersection of the first and second lines to find an actual peak-to-peak voltage knee value; and determining the threshold voltage as half of the actual peak-to-peak voltage knee value.

5. The method of claim 1 further comprising employing a component of the transfer subsystem.

6. The method of claim 1 wherein the current is AC and the voltage is peak-to-peak voltage.

7. The method of claim 1 wherein the current and voltage are DC and the method further comprises determining dielectric thickness using the slope and process parameters.

8. The method of claim 7 wherein the component is a component of the transfer subsystem and the method further comprises finding an intercept value of the voltage for zero current and determining the dielectric thickness from the intercept value.

9. In a xerographic apparatus including at least one photoreceptor, at least one photoreceptor charging subsystem, at least one imaging subsystem, and at least one transfer subsystem, a photoreceptor thickness determination method comprising charging a photoreceptor to a first predetermined value, supplying current to a component of a subsystem at a first predetermined current value, measuring the voltage of the component to obtain a first component voltage, repeating charging, setting, and measuring for at least a second predetermined charging value and at least a second predetermined current value to obtain at least a second component voltage, calculating a best fit line for the first and at least second voltage values, determining the slope of the best fit line, and calculating dielectric thickness based on the slope wherein the function used to obtain the slope of the best fit line comprises:

$$V_{BCR} = V_{OPC}^{0} - V_{TH} + \frac{I_{BCR}}{\beta},$$

wherein $V_{BCR}$ is the DC voltage applied to the component, $I_{BCR}$ is the DC current applied to the component, $V_{OPC}^{0}$ is the photoreceptor potential, and $1/\beta$ is the slope of the best fit line.

10. The method of claim 9 wherein the function used to obtain dielectric thickness comprises:

$$\beta = \frac{\varepsilon_0 L_{BCR} v_{process}}{/D_{IOC}},$$

wherein $V_{process}$ is the process speed, $L_{BCR}$ is the length of the component in the cross-process direction, $E_0$ is the permittivity of free space, and $D_{OPC}$ is the dielectric thickness of the photoreceptor.

11. The method of claim 9 wherein determining the dielectric thickness $D_{OPC}$ comprises determining the slope of the line representing a DC current versus DC voltage curve for the component, finding an intercept value of the component voltage for a component current value of zero, determining the threshold voltage from a relationship between the component voltage intercept value and the photoreceptor surface potential, and determining $D_{OPC}$ from a relationship between the threshold voltage and $D_{OPC}$.

12. The method of claim 11 wherein the relationship between threshold voltage, photoreceptor surface potential, and component voltage intercept value is $V_{TH}=V_{OPC}^{0}-V_{BCR}^{INTERCEPT}$ and the relationship between the threshold voltage and $D^{OPC}$ is $$V_{TH}=312+87.96\sqrt{D_{OPC}}+6.2D_{OPC}.$$

13. The method of claim 9 wherein the subsystem is a charging subsystem and the component is a biased charging roller.

14. In a xerographic apparatus including at least one photoreceptor, at least one photoreceptor charging subsystem, at least one imaging subsystem, and at least one transfer subsystem, a method of measuring photoreceptor surface potential with a component of a subsystem comprising:

discharging the photoreceptor;

operating the component in a constant DC current mode;

measuring a first voltage across the component resulting from the constant current operation;

charging the photoreceptor using the target surface potential; operating the component in the constant DC current mode; measuring a second voltage across the component resulting from the constant current operation; and determining the actual surface potential for the target potential to be a difference between the second and first voltages wherein the relationship between a threshold voltage, photoreceptor surface potential, and component voltage intercept value is $V_{TH}=V_{OPC}^{0}-V_{BCR}^{INTERCEPT}$ and the relationship between the threshold voltage and $D_{OPC}$ is $$V_{TH}=312+87.96\sqrt{D_{OPC}}+6.2D_{OPC}.$$

15. The method of claim 14 wherein the charging subsystem includes a biased charging roller and employing a component of the charging subsystem comprises employing the biased charging roller.

16. In a xerographic apparatus including at least one photoreceptor, at least one photoreceptor charging subsystem, at least one imaging subsystem, and at least one transfer subsystem, a photoreceptor thickness determination method comprising charging the photoreceptor using a target potential, finding an actual photoreceptor surface potential $V_{OPC}$ using at least one of the charging subsystem, the transfer subsystem, and an ESV, and determining the dielectric thickness of the photoreceptor wherein the function used to obtain dielectric thickness comprises:

$$\beta = \frac{\varepsilon_0 L_{BCR} v_{process}}{/D_{IOC}},$$

wherein $V_{process}$ is the process speed, $L_{BCR}$ is the length of the component in the cross-process direction, $E_0$ is the permittivity of free space, and $D_{OPC}$ is the dielectric thickness of the photoreceptor.

17. The method of claim 16 in which determining the dielectric thickness comprises operating a transfer subsystem component in constant DC current mode and using a relationship between the dielectric thickness and a difference between a DC transfer voltage employed by the transfer subsystem and the actual photoreceptor surface potential.

18. The method of claim 16 wherein determining the dielectric thickness comprises measuring a transfer subsystem component applied voltage and photoreceptor surface potential for at least two transfer subsystem component current values, determining a difference between each respective pair of transfer subsystem component voltage and surface potential values, determining a slope of a line joining points represented by the current and difference values, and using the slope to find the dielectric thickness.

19. The method of claim 16 wherein determining the dielectric thickness comprises measuring a transfer subsystem component applied voltage and photoreceptor surface potential for at least two transfer subsystem component current values, determining a difference between each respective pair of transfer subsystem component voltage and surface potential values, determining a slope of a line joining points represented by the current and difference values, finding an intercept value of transfer subsystem component voltage for a transfer subsystem component current, the intercept value representing the threshold voltage, and determining the dielectric thickness from the threshold voltage.

20. A xerographic marking engine optimization method comprising determining at least one of a surface potential and a dielectric thickness of a photoreceptor of the marking engine and adjusting at least one xerographic process actuator of the marking engine based on a relationship between at least one of a threshold voltage and the dielectric thickness and the at least one actuator wherein the function used to obtain dielectric thickness comprises:

$$\beta = \frac{\varepsilon_0 L_{BCR} v_{process}}{/D_{IOC}},$$

wherein $V_{process}$ is the process speed, $L_{BCR}$ is the length of the component in the cross-process direction, $E_0$ is the permittivity of free space, and $D_{OPC}$ is the dielectric thickness of the photoreceptor.

21. A xerographic marking engine optimization method comprising determining a dielectric thickness of a photoreceptor of the marking engine and determining when the photoreceptor has reached a minimum acceptable dielectric thickness wherein the function used to obtain dielectric thickness comprises:

$$\beta = \frac{\varepsilon_0 L_{BCR} v_{process}}{/ D_{IOC}},$$

wherein $V_{process}$ is the process speed, $L_{BCR}$ is the length of the component in the cross-process direction, $E_0$ is the permittivity of free space, and $D_{OPC}$ is the dielectric thickness of the photoreceptor.

* * * * *